United States Patent [19]

Eckart

[11] 4,052,086

[45] Oct. 4, 1977

[54] SAFETY SKI BINDING

[76] Inventor: Erich Eckart, Oettingenstrasse 54, 8000 Munich 22, Germany

[21] Appl. No.: 653,391

[22] Filed: Jan. 29, 1976

[30] Foreign Application Priority Data

Feb. 1, 1975 Germany ..... 2504281

[51] Int. Cl.[2] ..... A63C 9/08

[52] U.S. Cl. ..... 280/618

[58] Field of Search ..... 280/618, 617, 620, 631, 280/613

[56] References Cited

U.S. PATENT DOCUMENTS 3,937,480 2/1976 Korger ..... 280/618

3,963,253 6/1976 Rieger ..... 280/617

*Primary Examiner*—Robert R. Song

[57] ABSTRACT

A safety binding for attachment of a ski to the boot of a skier in which is provided a plate coextensive with the length of the boot pivotally attached to the ski at the center or rotation of the leg of said skier and a heel holding element having resilient securing means for holding the heel under torsional and tensile loads. A single system is provided for release of the securing means which operable in response only to a pulling force resulting from a tensile load on the leg and a coupling system for converting the rotation of the plate in response to a torsional movement of said leg into a pulling force.

13 Claims, 3 Drawing Figures

SAFETY SKI BINDING

BACKGROUND OF THE INVENTION

The present invention relates to an improved safety ski binding. A safety ski binding is disclosed in U.S. application Ser. No. 529,400 filed Dec. 7, 1974, having a plate adapted to receive the entire length of the ski-boot, which plate is fastened to the ski at the center of rotation of the leg and which is pivotable about its axis within a plane parallel to the ski. A single holding element, designed to engage the heel of the ski-boot, is joined to the ski so as to be capable of swiveling to all sides and to have a release characteristic operable to disengage the ski-boot under given tortional and tensile stress, placed on the leg.

This safety ski binding, having only one holding element is advantageous from an economic point of view. Furthermore, it permits the release force to be held constant even under varying stresses and permits the transfer of such stresses caused by frontal falls and rotating falls without undue strain on the leg.

The heel-holding element of the aforementioned application, is universally pivotable and has a release characteristic operable to all sides. However the universal release characteristic is obtained by the use of a pair of spring loaded piston systems, in which the brace or support forming the piston catch or stop for the tension force system and for the piston catch are separate from each other. By arranging the holding element to be universally pivotable with respect to the ski, both release systems may be so situated, that a release characteristic on all sides can thus be obtained.

The construction of this heel holding element is however complex, since two release systems and parts for the universal pivoting have to be made.

It is the object of the present invention, to simplify the construction of a safety ski binding by providing a single heel-holding element with only a single release system, having a universally directed release characteristic.

The objects and advantages will be apparent from the following description of the invention.

SUMMARY OF THE INVENTION

According to the present invention, a safety ski-binding of the aforementioned type is provided with a heel-holding element having a heel engaging means in which only single release system is employed which is operable in response only to a pulling force resulting from a tensile load on the leg and which includes coupling means for connecting the plate to the holding element and converting the rotational movement of the pivotal boot plate to a tensional force. As a result disengagement of the boot holding element is effected in the same mechanical manner by reaction to frontal falls, and by way of the coupling to torsional falls. The coupling and guide means serve only to convert the rotational movement of the plate into a pulling force exerted in the release direction on the heel-holding element.

In particular, the heel-holding element comprises spring-loaded piston release system which is directly tripped at a predetermined tensional force, and is indirectly tripped through the associated coupling by conversion of the rotational force created by movement of the plate to the given tensional force. Even though the release force system reacts only to a single predetermined release force, (i.e. the tensional force) the specific values for both tensional and rotational actuating forces can be chosen differently.

The present safety ski binding can be further simplified in its construction, by connecting the heel-holding element securely to the pivoting boot plate, so long as it is pivotable in a plane parallel to longitudinal axis of the pivotal boot plate so as to be engaged and disengaged with the boot. The pivotal boot-plate and the holding element therefore can form a single unit which is pivotably connected with the ski.

The release force necessary to trip the heel-holding element, in response to tensional stress on the leg, which occurs from frontal falls can be freely chosen by providing a spring loaded system which can be regulated in its bias. The release force necessary to trip the heel engaging element in response to torsional stress, which occurs by movement of the boot-plate from torsional falls, can be adjusted by selectively varying the coupling system or the position of its individual members. Thereby in a simple manner the control means for operating the binding is adjustably secured.

The coupling mechanism may be constructed in different ways. An especially simple embodiment is provided by extending the housing, in which the spring loaded piston release system is situated, with a downwardly projecting rudder member which sits within the bight of a U shaped of V shaped guide stirrup, fastened along the central axis of the ski. The arms of the stirrup which surround the rudder members are curved to provide cam surfaces of the desired ratios to pivot the housing about the longitudinal axis of the boot-plate in response to a predetermined rotational movment of the pivotal boot-plate. The known holding element has thus only to be provided with a rudder member, which cooperates with the cam like stirrup secured on the ski. Consequently constructions which are known for the spring loaded piston release system can be used. The conversion of the rotational movement of the plate into a release force for the particular release system which is being used, can be further improved, by forming the rudder member with a roller having a rotational perpendicular axis to the plane of the ski. In this way a sliding of frictional movement between the rudder member and the stirrup is avoided. To avoid interference with the rotational movement of the pivotal boot-plate the rudder member of the housing may be formed as a lengthened extension over the pivotal axis of the heel-holding element, and that the pivotal boot-plate terminates in front of the rudder member when in its rest position. Of course the rudder member can also be arranged on the pivotal boot-plate and the stirrup on the holding element. The double usage of the spring loaded release system can also be obtained by retaining a pulling cord as the coupling means. The cord is arranged through a guide hole secured on the ski as guide means, and is connected at one end to the housing of the spring loaded piston release system and at its other end to the plate at a point spaced from its rotational axis.

Since the pivotal boot-plate is spaced from the upper surface of the ski by its radial/thurst bearing, the pull cord and the guide hole are arranged between the upper surface of the ski and the underpart of the pivotal boot plate.

The fastening of the pull cord can be further simplified when it is fastened to the guide hole secured on the ski and on the rudder member of the holding element. In each case the pull cord having a defined length pivots the heel-holding element into its release direction, when a rotation of the pivotal boot-plate takes place.

Full details of the present invention are set forth in the following description, and are shown in the accompanying drawings.

DESCRIPTION OF THE INVENTION

Figure 1:
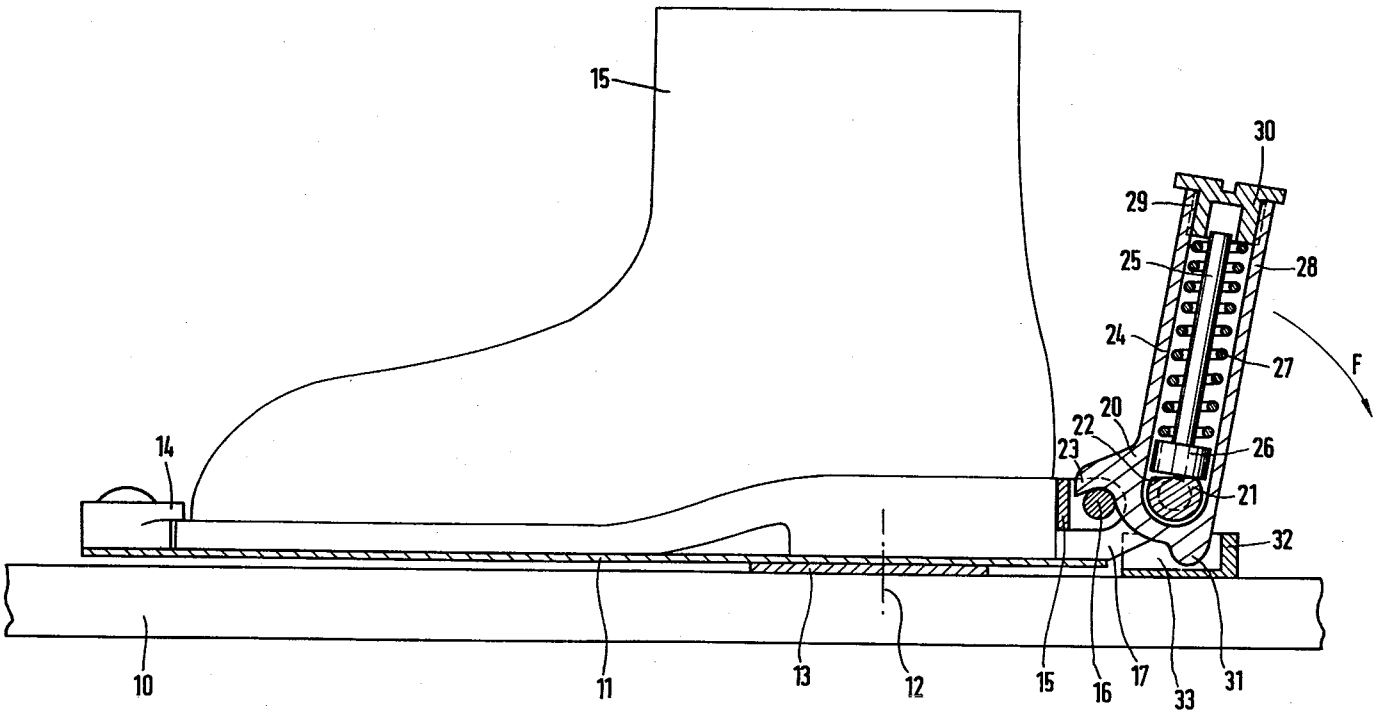
FIG. 1 is a side elevational view of a ski and skibinding according to the present invention, showing the heel-holding element in section.

Turning to FIG. 1, there is seen an association with a ski, generally indicated by the numeral 10, a safety ski binding comprising a pivotable boot-plate 11 provided with elements 14, adapted to receive the toe of the boot 15. The pivotable plate 11 is mounted on the ski so as to be swivelable about a vertical axis 12 by being journalled in a known radial/thrust bearing 13 such as that shown in the aforementioned application. The axis 12 lies along the center of rotation of the leg of the skier. To the rear of the heel of the boot 15 there extends a V-shaped hasp **15*a* having a transverse locking roller 16. Extending upwardly and to the rear, in unitary or integral construction with the bootplate 11 are a pair of bearing walls 17 and 19, at the upper end of which is pivotally journalled the heel-holding element, generally depicted by the numeral 20. The heel-holding element 20 is rotatably mounted about an axle 21, extending at right angles to the axis of the boot-plate 11, which axle 21 is itself rotatably mounted in the bearing walls 17 and 19. The heel-holding element 20 is formed with a forward boss 23 which is hooked or otherwise shaped so as to engage the heel of the ski boot and locks therewith when the heel holding element is forced forward toward the boot. The heel-holding element 20 is generally formed by a cylindrical housing 28 which is provided with an inner bore 24 in which is mounted a piston 26 under constant bias by a compression spring 27. The compression spring 27 is slidably mounted about a piston rod 25 and abuts at one end against the piston 26 and at the other end against a threaded cap 30, which is received in a similarly threaded portion at the upper end of the cylinder 28. The screw adjustment of the cap 30 enables the adjustment and variation of the bias of the spring 27 on the piston 26**.

Figure 3:
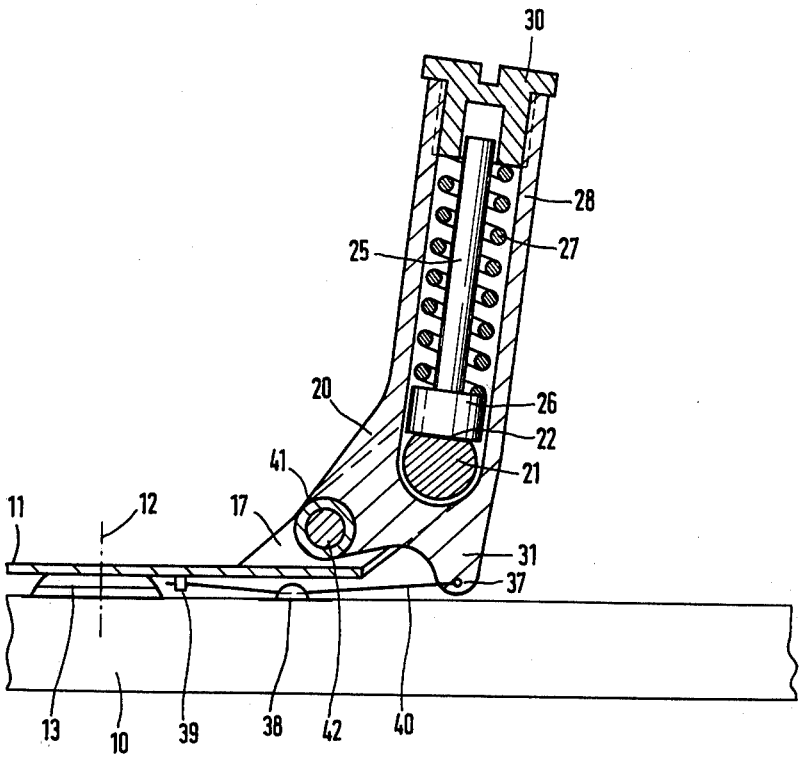
FIG. 3 is a perspective view of still another embodiment of the heel-holding element.

The piston 26 abuts itself against the bearing axle 21 the upper surface 22, or contacting surface of which is flattened, chordaly with respect to its cross section, as seen in FIG. 3 so that when the cylinder 28 is made to extend perpendicular to the ski, in engagement with the boot hasp, then a catch is formed in which the face of piston 26 stands flush on the flattened surface 22 of the pin 21. In this position, the reaction of the piston and the spring causes the housing cylinder 28 to be normally biased, counterclockwise, as seen in the drawings, so that the hooked boss 23 is forced into engagement with the locking roller 16, securing the boot 15 in place. In order to release this catch position, and thereby disengage the boot, the housing cylinder 28 must be swung in the direction indicated by the arrow F, as seen in FIG. 1. This however requires an increased force so that the spring loaded piston 26 can be moved over the edge of the flattened surface 22. Such a force must above all overcome the force of the compression spring 27. By this pivoting of the housing cylinder 28, there is created a pressure point along the transverse rear edge of the surface 22, which defines the release force of the heel-holding element. This pressure point is so situated that under normal ski conditions the boot 15 can make a limited movement before causing pivoting of the housing cylinder even under a pulling load from the leg. Only when this pressure point is overridden by a predetermined stress is the holding element released. The value or level of release force necessary to trip the housing cylinder 20 beyond the pressure point is selectively adjustable by regulation of the cap 30. Movement of the housing cylinder 20 can of course be effected directly by manual operation, or by a frontal fall by the skier causing the boot 15 to exert a direct tension force in the upward direction through the locking roller 16, on the engaged boss 23, resulting in a force vector following the arrow F, since the housing is freely rotatable about the axle 21.

Figure 2:
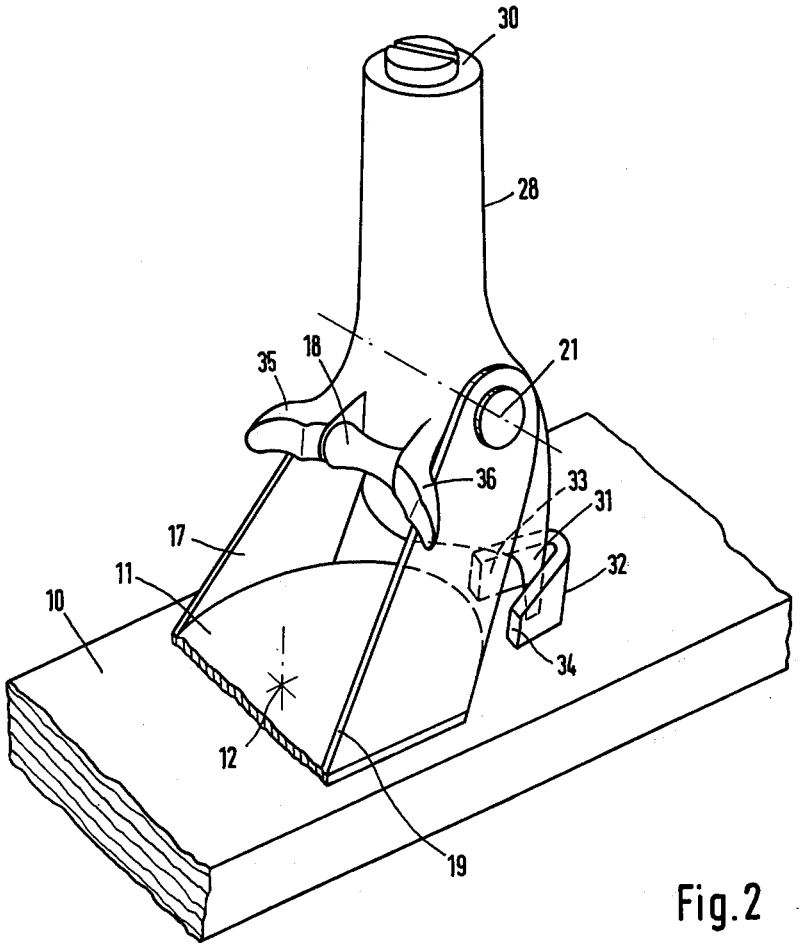
FIG. 2 is a view of another embodiment of the holding element.

To effect the release of the boot in response to a torsional fall of the skier, the housing cylinder 20 is lengthened below the pivot axis 21 of the housing 20 to provide a downward projection forming a rudder member 31, which is as seen in FIG. 2 adapted to extend within the arms 33 and 34 of a U or V-shaped stirrup 32 which is secured to the ski along the central longitudinal axis. When the pivotal boot-plate 11 is not rotated, the rudder member 31 lies freely in the bight of the stirrup. However, both arms 33 and 34 of the U or V-shaped member 32 form a curve which by rotation of the boot-plate 11 about its axis 12 causes the rudder member 31 to come in contact with it. Preferably the arms 33 and 34 as well as the rudder member 31 are shaped to form sliding cam surfaces so that rotation of the boot-plate 11 beyond a predetermined angle to the right or left, causes a force to be exerted on the rudder member 31 which results in a clockwise pivoting of the housing 20 about the axis 21 in the direction of the arrow F. The rudder member 31 and the stirrup 32 are arranged and situated so that their interaction results in the tripping of the piston 26 over the pressure point when a predetermind rotating or torsion stress is placed on the boot-plate 11. The rudder member 31 and stirrup 32 function only to transfer the rotational movement of the boot-plate 11 into a linear movement by which the housing cylinder 28 is swivelled about its axle 21. This release can occur through a force which is over or above the predetermined release force which was originally set into the holding element as well as one which is different from the tensile stress caused by movement of the leg. The rudder member 31 and the stirrup 32 can also be arranged in a different manner and can even be interchanged.

As seen in FIG. 2 the ski boot may be engaged by a roller 18 which is set between a pair of members 35 and 36. The roller 18 may engage the rear of the boot itself, or member, such as the hasp, secured to the boot. The roller 18 and the members 35 and 36 form an arcuate clamp fitting the boot. The boot-plate 11 ends in front of the stirrup 32 so that it can be as near as possible to stirrup 32. The stirrup 32 may be adjustably fastened to the ski 10 so that the predetermined release value, in response to any of the rotatable loads can be selectively adjusted and regulated. The rudder member 31 can also be provided with a roller engaging the arms 33 and 34 of stirrup in order to prevent friction and embrace the caming action.

In the embodiment shown in FIG. 3, the housing cylinder 28 is provided with a roller 41 having its ends 42 journalled with the boss 23 which is modified to receive the same. The guide roller 41 is adapted to bear deeply within the rear end of the boot 15. The spring loaded release system is unchanged from that disclosed earlier, being pivotal about the axle 21 in a plane vertical to the plane of the boot-plate and parallel to its longitudinal axis as aforedescribed. A pull cord 40 is secured in a hole 37 in the rudder member 31, extends through a guide hole or eyelet 38 which is secured to the upper facce of the ski 10 and is fastened to a fitting 39 secured to the rear of the boot-plate 11 outside of its rotary axis 12. The cord 40 acts as a coupling mechanism between the pivotal boot-plate and the heel-holding element, whereby the rotary movement of the boot-plate is translated into a pulling movement on the housing cylinder in response to any torsional stress. Thus when the boot plate 11 takes its noraml position aligned with the ski (which is not turned) then the catch position of the heel-holding element and the pull cord 40 is stretched in a substantially straight line so that the fixed end point 39, the hole 38 and the rudder member 31 lie in a single line. Should the boot-plate 11 be pivoted about its axis 12 then the fixed end filling 39 on the plate translated or moved to the one side of the eyelet 38, simultaneously drawing into an angle substantially like a V form. Since the length of the pull cord 40 remains constant being fixed at both ends, the distance between the fitting 39 and the rudder member 31 must decrease. Since only the heel-holding element is pivotal, it will move in the direction of arrow F. This means, that by a rotational change in the boot-plate 11, the heel-holding element (i.e. housing cylinder 28) is also moved and pivoted about its axle 21. The relationship is such that when a certain rotating angle of the boot-plate 11 is reached resulting in a predetermined pivoting of the heel-holding element the engagement between the piston 26 and the flattened catch surface 22 of the axle is released just as in the earlier embodiments The length of the cord 40 can be changed by adjusting the position of the filling 39 on the boot-plate 11. The guide hole 38 can be variably positioned on the ski 10 by using as adjustable fastening means. Accordingly, the release of the heel-holding element at a predetermined rotating load can be obtained independently of any direct release action resulting from a frontal movement or fall of the leg.

The pull cord 40 can be secured to the ski at its front end rather than to the boot-plate. The other end of the cord can be fastened to the eyelet 38 which may then be secured to the boot-plate 11, or fastened in the bore 37 on the rudder member 31. In any event, a pivoting of the boot-plate 11 thereby also causes a pivoting of the heel-holding element about its axle.

Various modifications, changes and embodiments have been shown and others will be obvious to those skilled in the art. Accordingly, the present disclosure is intended to be taken as illustrative of the present invention and not as limiting of its scope.

What we claim is:

1. A safety binding for attachement of a ski to the boot of a skier comprising in combination a plate coextensive with the length of the boot means for unseparably connecting said plate to said ski for pivitol movement relative to the ski at the center of rotation of the leg of said skier, to freely rotate relative to said ski, a heel holding element mounted on said plate for rotation therewith, said heel holding element having resilient securing means for releasably holding said heel under torsional and tensile loads on said plate and means for the release of said resilient securing means operable in response only to a pulling force resulting from a tensile load on said leg and a coupling system interconnecting said ski and said heel holding element for converting the rotation of said plate relative to said ski in response to a torsional movement of said leg into a pulling force to releasing said resilient securing means

2. The binding according to claim 1 wherein said heel-holding element is pivotal about an axis transverse to the longitudinal axis of said plate, into and out of engaged position with said boot, said release means comprises a spring loaded piston which releases at predetermined pulling force, and said coupling means is arranged to pivot said heel-holding element in response to a predetermined rotational movement of said plate to cause release of said spring loaded piston.

3. The binding according to claim 2 wherein the release force of the spring loaded piston is adjustable.

4. The binding according to claim 2 wherein said coupling means is adjustable to vary its response to torsional movement.

5. The binding according to claim 2 wherein said heel-holding element, comprises a housing for said spring load piston system, said housing being provided with an extending rudder member, and said coupling system comprises a stirrup member secured to said ski having a pair of arms between which said rudder member is received, said rudder member and said stirrup arms cooperating on rotation of said plate to pivot said housing.

6. The binding according to claim 5 wherein said stirrup is substantially U or V-shaped.

7. The binding according to claim 5 wherein said stirrup is adjustably secured to said ski.

8. The binding according to claim 5 wherein said stirrup arms and said rudder members are formed with cam surfaces.

9. The binding according to claim 8 wherein said plate is journalled by a radial thrust bearing spaced from said ski and the pulling cord is arranged between the upper surface of said ski and the undersurface of said plate.

10. The binding according to claim 5 wherein the rudder member is formed as a lengthened projection beyond the rotational axis of the housing and the plate ends in front of said rudder member in the rest position.

11. The binding according to claim 10 wherein said pull cord is fixedly secured to the coupling secured to said ski and to the rudder member.

12. The binding according to claim 2 wherein said heel-holding element comprises a housing for said spring loaded piston system, and said coupling comprises a pull cord extending between said plate and said housing and being coupled to said ski whereby on rotation of said plate said pull cord draws on said housing.

13. The binding according to claim 12 wherein said pull cord is fixed at both ends to said plate and housing respectively, and is freely movable over the coupling secured to said ski.

* * * * *